US005338618A

United States Patent [19]

Suzuki et al.

[11] Patent Number: 5,338,618

[45] Date of Patent: Aug. 16, 1994

[54] ELECTRIC CONTACT MATERIAL AND ELECTRIC CONTACT USING SAID MATERIAL

[75] Inventors: Satoshi Suzuki; Nobuyuki Shibata, both of Nikko; Ryotomo Shirakawa, Imaichi; Akira Matsuda, Kiyotaki, all of Japan

[73] Assignees: The Furukawa Electric Co., Ltd., Tokyo; Mabuchi Motor Kabushiki Kaisha, Matsudo, both of Japan

[21] Appl. No.: 951,587

[22] Filed: Sep. 25, 1992

Related U.S. Application Data

[62] Division of Ser. No. 556,825, Jul. 23, 1990, Pat. No. 5,171,643.

[30] Foreign Application Priority Data

Aug. 2, 1989 [JP] Japan ..... 1-200860
Aug. 2, 1989 [JP] Japan ..... 1-200861

[51] Int. Cl.[5] ..... C22C 5/06; H01H 1/02

[52] U.S. Cl. ..... 428/614; 428/673; 428/674; 148/431; 200/266

[58] Field of Search ..... 148/431; 428/614, 673, 428/674; 200/266

[56] References Cited

U.S. PATENT DOCUMENTS 2,221,285 11/1940 Hensel et al. ..... 420/501
4,374,668 2/1983 Desai et al. ..... 420/507
4,456,662 6/1984 Malikowski et al. ..... 428/673

FOREIGN PATENT DOCUMENTS 3224439 2/1983 Fed. Rep. of Germany .
51-136170 11/1976 Japan .
52-9625 1/1977 Japan .
52-013688 2/1977 Japan .
52-30217 3/1977 Japan .
54-6008 3/1979 Japan .
54-149322 11/1979 Japan .
58-104139 6/1982 Japan .
58-104141 6/1983 Japan .
58-107441 6/1983 Japan .
58-107458 6/1983 Japan .
58-210133 12/1983 Japan .

OTHER PUBLICATIONS

World Patents Index, Week 7711, Derwent Publications Ltd., London, GB; AN 77-18940Y (11) of JP-A-52 013 689, Feb. 1977.

Patent Abstracts of Japan, vol. 007, No. 205, Sep. 9, 1983, of JP-A-58 104 141 (Tanaka Kikinzoku), Jun. 2, 1983, Japan.

World Patents Index Latest, Week 8506, Derwent Publications Ltd. London, GB; AN 85-035087 of JP-A-59 229 440 (Tanaka Kikinzoku), Dec. 22, 1984.

Patent Abstracts of Japan, vol. 007, No. 205, Sep., 9, 1983 of JP-A-58 104 139 (Tanaka Kikinzoku), Jun. 21, 1983, Japan.

*Primary Examiner*—Richard O. Dean
*Assistant Examiner*—Margery S. Phipps
*Attorney, Agent, or Firm*—Frishauf, Holtz, Goodman & Woodward

[57] ABSTRACT

An electric contact material containing Li oxide of 0.01 to 2.0% by weight when represented in terms of the amount of Li, oxide of at least one rare earth element of 0.05 to 0.18% by weight when represented in terms of the amount of the rare earth element, and Ag or Ag alloy as the remaining portion; an electric contact material containing Li oxide of 0.01 to 2.0% by weight when represented in terms of the amount of Li, at least one rare earth element of 0.05 to 0.18% by weight when represented in terms of the amount of the rare earth element, at least one element selected from a group consisting of In, Sn, Zn, Mn, Pd, Sb, Cu, Mg, Pb, Cd, Cr and Bi by an amount of 0.1 to 1.0% by weight (however, in the case of Zn and Mn, the amount is set less than 0.5% by weight), and/or at least one element selected from a group consisting of Fe, Ni and Co by an amount of 0.03 to 0.6% by weight, and Ag as the remaining portion; and an electric contact formed by using the above material. It is excellent in the arc resistance, wear resistance an lubricity in a small current region and is suitable as the material for a slide contact and rotary slide contact.

9 Claims, No Drawings

ELECTRIC CONTACT MATERIAL AND ELECTRIC CONTACT USING SAID MATERIAL

This is a division of application Ser. No. 07/556,825, filed Jul. 23, 1990, now U.S. Pat. No. 5,171,643, issued Dec. 15, 1992.

FIELD OF THE INVENTION

This invention relates to an electric contact material which is excellent in arc resistance, lubricity and abrasion resistance and whose contact resistance is low and stable when it is in use, a method for manufacturing the same and the electric contact formed of the material, and more particularly to an electric contact material suitable for slide contacts mounted on an electronic/electric device such as small-sized slide switches and a micro-motor driven by a small current.

DESCRIPTION OF THE BACKGROUND ART

In the prior art, Ag—Cu alloys containing Cu of 1 to 20% by weight, Ag—Ni alloys containing Ni of 1 to 20% by weight and the like are widely used as materials of electric contact such as a make and break contact incorporated into a relay or breaker, a slide contact incorporated into slide switches and a rotary slide contact mounted on motors.

However, the above materials are not recognized to have high arc resistance and abrasion resistance and sticking resistance becomes a problem. Particularly, the Ag—Cu alloy has a problem that its contact resistance increases and becomes unstable by the Cu oxide formed on its surface while it is used. Therefore, when a slide contact is formed of an Ag—Cu alloy and used as an outer peripheral contact piece of the commutator of a small-sized motor, the contact resistance varies, causing unstable rotation speed of the motor.

On the other hand, an Ag-metal oxide alloy is known as a contact material having a high sticking resistance.

For example, an Ag-manganese oxide alloy (refer to Japanese Patent Disclosure Nos. 51-136170 and 52-30217), Ag-indium oxide alloy (refer to Japanese Patent Disclosure No. 52-9625), Ag-zinc oxide alloy (refer to Japanese Patent Disclosure No. 54-149322) and Ag-oxide alloy in which the oxide indispensably contains an lithium oxide and additionally contains more than one of aluminium oxide, calcium oxide, magnesium oxide and silicon oxide (refer to Japanese Patent Disclosure No. 58-210133) are known.

The above Ag-metal oxide alloys are obtained by a method of heating an alloy of a certain composition of metal elements in an oxidizing atmosphere for a predetermined time to cause internal oxidation of the added elements other than the base material or Ag and precipitate a fine oxide of the added elements along the grain boundary of Ag.

The Ag-metal oxide alloy formed by the above internal oxidation method becomes a material whose sticking resistance or wear resistance is improved by the effect of the fine particles of the oxide of the added elements precipitated along the grain boundary of Ag when it is used as a contact material.

A slide contact material is widely used for various types of printers, cameras, VTRs in forms of a slide switch for a small current region or a rotary slide contact of a micromotor.

Various materials have been proposed for the above slide contact material. For example, an Ag—Cu alloy disclosed in Japanese Patent Disclosure No. 58-104139; an Ag—Sb alloy disclosed in Japanese Patent Disclosure No. 58-104141; an Ag—Zn alloy disclosed in Japanese Patent Disclosure No. 58-107441 and Ag—In alloy disclosed in Japanese Patent Disclosure No. 58-107458 are known.

Although not specified as a slide contact material, an Ag alloy containing Li and a rare earth element as indispensable components and a material obtained by subjecting the same to the internal oxidation process are known as a contact material which is good in resistance and wear resistance as is disclosed in Japanese Patent Publication No. 54-6008.

The above material has been developed mainly for a make and break contact material and is effectively used in the medium current region of approx. 1 to 100 A.

Recently, various types of electronic devices described above are required to be made further smaller and at the same time they are required to have a higher performance and higher reliability. Further, the devices are used in various environments, and for example, they may be sometimes used in an organic gas atmosphere containing a small amount of ammonia or formalin or in an atmosphere of high temperature and humidity.

In order to satisfy the above conditions, the electric contact incorporated into the above devices is required to have the following characteristics.

First, the electric contact incorporated in the device must be made smaller as the size of the device is reduced. At this time, the application current becomes small and the contact pressure tends to become smaller. For example, it is frequently used in a condition that current is set to 50 mA to 1 A and a pressure is set less than 10 g. Thus, when the application current becomes small and the contact pressure becomes small, abnormal contact resistance tends to occur in the contact portion, so that it becomes necessary to set the contact resistance of the a low contact material in contact portion in order to solve the above problem.

Further, when the contact pressure becomes small, a small arc occurs on the contact surface during the sliding operation in a slide contact, increasing wear of the material and therefore the material is required to have a higher arc resistance.

Further, as the contact is made smaller, the cross sectional area of the conductor portion becomes smaller. As a result, the total resistance of the contact becomes larger and the amount of heat generated in the contact while it is used increases, and the contact material is required to have a small resistivity.

The long service life of the contact is a factor of ensuring high reliability. Therefore, the contact material is required to be hard enough to be wear resistance.

Further, in the case of the rotary slide contact incorporated into a micromotor, for example, it is necessary to keep the contact resistance with time at a low and stable level in order to suppress the fluctuation of revolutions during the operation. In particular, the contact resistance thereof must be kept constant with time even when it is used for a long time in ammonia or an organic gas atmosphere, or in a high temperature and high humidity atmosphere. Therefore, the contact material is strongly required to have various corrosion resistances including oxidation resistance, sulfidization resistance, ammonia resistance and organic gas resistance.

In addition, recent micromotors tend to be operated at high speeds, for example, at a rotation speed of 5000 to 20000 rpm. However, in order to achieve the high speed operation with high stability, the slide contact incorporated in the motor must be formed by a material having a small friction coefficient and good lubricity.

SUMMARY OF THE INVENTION

An object of this invention is to provide a material useful for a slide contact used in a small current region, a method for manufacturing the material and the slide contact formed of the material.

Another object of this invention is to provide an electric contact material which is excellent in arc resistance, lubricity and wear resistance and whose contact resistance is low and stable when it is used, a method for making the material and the electric contact formed of the material.

This invention provides an electric contact material comprising Li of 0.02 to 2.0% by weight, at least one rare earth element of 0.01 to 0.2% by weight and Ag as the remaining portion, and an electric contact formed of the material.

Another aspect provides an electric contact material comprising Li of 0.02 to 2.0% by weight, at least one rare earth element of 0.01 to 0.2% by weight, at least one element of 0.1 to 1.0% by weight selected from a group consisting of In, Sn, Zn, Mn, Pd, Sb, Cu, Mg, Pb, Cd, Cr and Bi (Zn and Mn must be set less than 0.5% by weight) and/or at least one element of 0.03 to 0.6% by weight selected from a group consisting of Fe, Ni and Co, and Ag as the remaining portion, and an electric contact formed of the material.

Still another aspect provides an electric contact material comprising lithium oxide of 0.02 to 2.0% by weight which is represented in terms of the amount of Li, an oxide of at least one rare earth element of 0.01 to 0.2% by weight which is represented in terms of the amount of the rare earth element and Ag or Ag alloy as the remaining portion, and an electric contact formed of the material.

Still another aspect provides a method for making an electric contact material comprising the step of heating an alloy which is formed of Li of 0.02 to 2.0% by weight, at least one rare earth element of 0.01 to 0.2% by weight and an Ag as the remaining portion in an oxygen atmosphere to carry out an internal oxidation of the Li and the rare earth element. Still another aspect provides a method for forming an electric contact material comprising the step of heating an alloy which is formed of Li of 0.02 to 2.0 % by weight, at least one rare earth element of 0.01 to 0.2% by weight, at least one element of 0.1 to 1.0% by weight selected from a group consisting of In, Sn, Zn, Mn, Pd, Sb, Cu, Mg, Pb, Cd, Cr and Bi (Zn and Mn must be set less than 0.5% by weight) and/or at least one element of 0.03 to 0.6% by weight selected from a group consisting of Fe, Ni and Co, and Ag as the remaining portion in an oxygen atmosphere to carry out internal oxidation of the Li and rare earth element.

DETAILED DESCRIPTION

The electric contact material of the first aspect of this invention is an Ag alloy containing Ag as a base material and Li and at least one rare earth element. At least one of La, Ce, Pr, Nd, Sm, Sc, Y, Eu, Gd, Tb, Dy, Ho, Er, Tm, Yb and Lu is used as the rare earth element. La and Ce among them are particularly preferable.

Li and a rare earth element enhance the hardness of a prepared Ag alloy to increase the wear resistance thereof and decrease the friction coefficient to enhance the lubricity and consequently enhance the arc resistance, thereby reducing the amount of wear when it is used as a contact.

In this case, if the amount of Li is less than 0.01% by weight and the amount of the rare earth element is less than 0.01% by weight, the above effect is not sufficient, and if the amount of Li is larger than 2.0% by weight or the amount of the rare earth element is larger than 0.2% by weight, the specific resistance of an Ag alloy obtained increases and the variation in the contact resistance with time becomes larger, thereby lowering the characteristic thereof when used as the contact material, and particularly as the material of a small-sized slide contact used in a small current region.

The preferable amount of Li lies in the range of 0.01 to 0.1% by weight, and further preferably, it is in the range of 0.02 to 0.1% by weight, and the preferable amount of the rare earth element lies in the range of 0.02 to 0.2% by weight.

If at least one of In, Sn, Zn, Mn, Pd, Sb, Cu, Mg, Pb, Cd, Cr and Bi is additionally composed into the Ag alloy of the above composition, the lubricity and hardness of the alloy are further enhanced, thus making it possible to enhance the wear resistance.

In this case, if the amount of added element or elements is less than 0.1% by weight, the above effect is insufficient, if the added amount is larger than 1.0% by weight, the specific resistance of the alloy increases and the variation in the contact resistance becomes large. The preferable amount lies in the range of 0.1 to 0.5% by weight, and more preferably, it is in the range of 0.1 to 0.3% by weight.

When Zn or Mn among the above elements is added, the amount of addition is set less than 0.5% by weight. This is because the specific resistance will increase and the variation in the contact resistance will become larger if it is added by more than 0.5% by weight.

Further, if at least one of Fe, Ni and Co is added to the Ag alloy, crystal grains in the Ag alloy obtained become smaller, thereby enhancing the wear resistance of the alloy.

If the addition amount is less than 0.03% by weight, the above effect cannot be sufficiently obtained, and if the addition amount is larger than 0.6% by weight, segregation occurs at the time of preparation of the alloy by melting the same, increasing the wear of the Ag alloy obtained due to the sliding operation thereof, and therefore it is not preferable. The preferable amount lies in the range of 0.03 to 0.2% by weight, and more preferably, it is in the range of 0.03 to 0.1% by weight.

The element in the group of In and the element in the group of Fe may be separately added but can be added simultaneously.

The electric contact material of this invention can be prepared by mixing a determined amount of each metal element and melting/casting the same in a high-frequency melting furnace, for example.

In a case where an electric contact is formed by using the above material, the casting of the material is subjected to a mechanical face cutting and then cold-rolled, for example, to work the same into a desired contact shape.

At this time, the above contact material may be integrally formed with the base material formed of Cu or Cu alloy or Fe or Fe alloy by cladding or caulking the same in a rivet form on the entire or partial surface portion of the base material.

An electric contact material according to another aspect of this invention is obtained by heating the above-described Ag alloy in an oxygen atmosphere such as atmospheric air to subject the Li and rare earth element contained therein to an internal oxidation.

In the above material, fine lithium oxide and an oxide of rare earth element are precipitated and uniformly distributed in the base metal of Ag or Ag alloy which contains at least one element included in the group of In and/or Fe so that the hardness and wear resistance can be enhanced and resultantly the amount of wear thereof can be reduced when it is used as a make and break contact or a slide contact in comparison with the Ag alloy which is not subjected to the internal oxidation process.

In this case, the amount of oxide of Li is controlled to be set within the range of 0.01 to 2.0% by weight which is represented in terms of the amount of Li and the amount of oxide of rare earth element is controlled to be set within the range of 0.01 to 0.2% by weight which is represented in terms of the amount of the rare earth element.

The condition for the internal oxidation is preferably set to such a condition that Ag of the base material, the group of In and the like and the group of Fe and the like, will not cause oxidation, that is, the Li and rare earth element in the Ag alloy can be selectively oxidized.

Such a condition is determined according to the amount of Li and rare earth element, the concentration of oxygen in an oxygen atmosphere, the temperature at the time of the oxidation process, the time of the process and the like. For example, when the oxygen atmosphere is atmospheric air and if the amounts of Li and the rare earth element are set within the above ranges, the processing temperature is preferably set in the range of 200° to 800° C. and the processing time is preferably set in the range of 10 seconds to 2 hours, depending on the thickness of the Ag alloy.

EMBODIMENT

Each Ag alloy of the compositions shown in the table 1 is cast using a high-frequency melting furnace to make samples. In this case, the condition for the internal oxidation process in the table is that the atmosphere is atmospheric air, the temperature is set at 400° C. and the processing time is set to 1 hour.

TABLE 1

| sample | composition (wt %) | | | | | | | | | | | | | | | | | | internal oxidation process |
|---|---|---|---|---|---|---|---|---|---|---|---|---|---|---|---|---|---|---|---|
| | | | rare earth element | | | | | | | | | | | | | | | | |
| No. | Ag | Li | La | Ce | Pr | Nd | Sm | In | Sn | Zn | Cu | Mn | Mg | Pb | Pd | Fe | Ni | Co | effected? |
| 1 | bal | 0.01 | 0.1 | — | — | — | — | — | — | — | — | — | — | — | — | — | — | — | No |
| 2 | bal | 0.05 | 0.1 | — | — | — | — | — | — | — | — | — | — | — | — | — | — | — | No |
| 3 | bal | 0.1 | 0.1 | — | — | — | — | — | — | — | — | — | — | — | — | — | — | — | No |
| 4 | bal | 0.5 | 0.1 | — | — | — | — | — | — | — | — | — | — | — | — | — | — | — | No |
| 5 | bal | 1.0 | 0.1 | — | — | — | — | — | — | — | — | — | — | — | — | — | — | — | No |
| 6 | bal | 2.0 | 0.2 | — | — | — | — | — | — | — | — | — | — | — | — | — | — | — | No |
| 7 | bal | 2.0 | 0.2 | — | — | — | — | — | — | — | — | — | — | — | — | — | — | — | Yes |
| 8 | bal | 0.1 | 0.01 | — | — | — | — | — | — | — | — | — | — | — | — | — | — | — | No |
| 9 | bal | 0.1 | 0.05 | — | — | — | — | — | — | — | — | — | — | — | — | — | — | — | No |
| 10 | bal | 0.1 | 0.1 | — | — | — | — | — | — | — | — | — | — | — | — | — | — | — | Yes |
| 11 | bal | 0.1 | 0.2 | — | — | — | — | — | — | — | — | — | — | — | — | — | — | — | No |
| 12 | bal | 0.1 | 0.5 | — | — | — | — | — | — | — | — | — | — | — | — | — | — | — | No |
| 13 | bal | 0.1 | — | 0.2 | — | — | — | — | — | — | — | — | — | — | — | — | — | — | No |
| 14 | bal | 0.1 | 0.1 | — | — | — | — | — | — | — | 0.1 | — | — | — | — | — | — | — | No |
| 15 | bal | 0.1 | 0.1 | — | — | — | — | 0.1 | — | — | — | — | — | — | — | — | — | — | No |
| 16 | bal | 0.1 | 0.1 | — | — | — | — | — | 0.1 | — | — | — | — | — | — | — | — | — | No |
| 17 | bal | 0.1 | 0.1 | — | — | — | — | — | — | 0.1 | — | — | — | — | — | — | — | — | No |
| 18 | bal | 0.1 | 0.1 | — | — | — | — | 0.1 | — | — | — | — | — | — | — | — | 0.05 | — | No |
| 19 | bal | 0.1 | 0.1 | — | — | — | — | — | 0.1 | — | — | — | — | — | — | — | — | 0.05 | No |
| 20 | bal | 0.005 | 0.1 | — | — | — | — | — | — | — | — | — | — | — | — | — | — | — | No |
| 21 | bal | 0.1 | 0.005 | — | — | — | — | — | — | — | — | — | — | — | — | — | — | — | No |
| 22 | bal | 3.0 | 0.1 | — | — | — | — | — | — | — | — | — | — | — | — | — | — | — | No |
| 23 | bal | 0.1 | 1.0 | — | — | — | — | — | — | — | — | — | — | — | — | — | — | — | No |
| 24 | bal | 0.1 | 0.1 | — | — | — | — | — | — | — | 1.5 | — | — | — | — | — | — | — | No |
| 25 | bal | 0.1 | 0.1 | — | — | — | — | — | 1.5 | — | — | — | — | — | — | — | 0.05 | — | No |
| 26 | bal | 0.1 | — | — | — | — | — | — | — | — | — | — | — | — | — | — | — | — | No |
| 27 | bal | — | 0.1 | — | — | — | — | — | — | — | — | — | — | — | — | — | — | — | No |
| 28 | bal | — | — | — | — | — | — | — | — | — | 10 | — | — | — | — | — | — | — | No |
| 29 | bal | — | — | — | — | — | — | 5 | — | — | — | — | — | — | — | — | — | — | Yes |
| 30 | bal | — | — | — | — | — | — | — | 5 | — | — | — | — | — | — | — | — | — | Yes |
| 31 | bal | 0.1 | — | — | 0.1 | — | — | — | — | — | — | — | — | — | — | — | — | — | No |
| 32 | bal | 0.1 | — | — | — | 0.1 | — | — | — | — | — | — | — | — | — | — | — | — | No |
| 33 | bal | 0.1 | — | — | — | — | 0.1 | — | — | — | — | — | — | — | — | — | — | — | No |
| 34 | bal | 0.1 | — | — | — | — | — | — | — | — | — | 0.1 | — | — | — | — | — | — | No |
| 35 | bal | 0.1 | — | — | — | — | — | — | — | — | — | — | 0.1 | — | — | — | — | — | No |
| 36 | bal | 0.1 | — | — | — | — | — | — | — | — | — | — | — | 0.1 | — | — | — | — | No |
| 37 | bal | 0.1 | — | — | — | — | — | — | — | — | — | — | — | — | 0.1 | — | — | — | No |
| 38 | bal | 0.1 | — | — | — | — | — | — | — | — | — | — | — | — | — | 0.05 | — | — | No |

For the respective samples, the area of the wearing portion and the contact resistance were measured by the fine movement frictional contact resistance test (Fretting test), the coefficient of dynamic friction was measured by using a Bowden type abrasion tester, and the contact resistance was measured before and after the samples were treated in the hot air and atmosphere under constant temperature/constant humidity conditions, as follows:

Fretting test:

Head: a rod formed of Ag—50% Pd and having a head portion with a radius of 1 mm

Load: 5 g

Current: 0.1 A, 1.0 A
Slide distance: 0.1 mm
The number of sliding times: 200000 and after the above operation and the contact resistance (mΩ) was measured.

The measurement result is shown in table 2.

TABLE 2

| sample No. | result of fretting test: contact resistance (mΩ) 0.1 A | 1.0 A | friction area ($mm^2$) | coefficient of dynamic friction (μk) | result of environment test (contact resistance, mΩ): before test | air heating test | constant temperature/constant humidity test |
|---|---|---|---|---|---|---|---|
| 1 | 13 | 11 | 0.08 | 0.48 | 3 | 3 | 3 |
| 2 | 9 | 5 | 0.03 | 0.32 | 3 | 4 | 4 |
| 3 | 15 | 6 | 0.03 | 0.27 | 3 | 6 | 5 |
| 4 | 20 | 8 | 0.03 | 0.20 | 4 | 8 | 6 |
| 5 | 24 | 10 | 0.03 | 0.18 | 5 | 12 | 8 |
| 6 | 30 | 12 | 0.03 | 0.15 | 6 | 15 | 12 |
| 7 | 26 | 9 | 0.02 | 0.14 | 3 | 18 | 13 |
| 8 | 20 | 11 | 0.07 | 0.38 | 3 | 5 | 4 |
| 9 | 16 | 5 | 0.03 | 0.32 | 3 | 6 | 5 |
| 10 | 13 | 5 | 0.02 | 0.23 | 3 | 6 | 5 |
| 11 | 20 | 8 | 0.03 | 0.20 | 3 | 7 | 7 |
| 12 | 26 | 10 | 0.03 | 0.18 | 4 | 8 | 8 |
| 13 | 23 | 10 | 0.03 | 0.20 | 3 | 7 | 7 |
| 14 | 36 | 15 | 0.06 | 0.23 | 4 | 15 | 10 |
| 15 | 24 | 12 | 0.05 | 0.25 | 3 | 8 | 7 |
| 16 | 27 | 13 | 0.05 | 0.23 | 3 | 10 | 8 |
| 17 | 30 | 13 | 0.05 | 0.25 | 3 | 12 | 13 |
| 18 | 26 | 16 | 0.05 | 0.21 | 3 | 10 | 8 |
| 19 | 31 | 16 | 0.05 | 0.21 | 4 | 11 | 13 |
| 20 | 45 | 25 | 0.31 | 0.78 | 3 | 3 | 3 |
| 21 | 40 | 20 | 0.14 | 0.45 | 3 | 6 | 5 |
| 22 | 52 | 21 | 0.04 | 0.13 | 9 | 26 | 20 |
| 23 | 43 | 22 | 0.06 | 0.16 | 5 | 10 | 7 |
| 24 | 62 | 28 | 0.07 | 0.15 | 5 | 32 | 26 |
| 25 | 40 | 23 | 0.07 | 0.20 | 4 | 24 | 18 |
| 26 | 50 | 20 | 0.14 | 0.45 | 3 | 6 | 5 |
| 27 | 55 | 21 | 0.29 | 0.85 | 3 | 3 | 3 |
| 28 | 90 | 40 | 0.13 | 0.20 | 12 | 120 | 70 |
| 29 | 50 | 30 | 0.12 | 0.25 | 7 | 40 | 35 |
| 30 | 60 | 35 | 0.13 | 0.23 | 8 | 45 | 40 |
| 31 | 16 | 7 | 0.03 | 0.27 | 3 | 6 | 5 |
| 32 | 15 | 7 | 0.03 | 0.28 | 3 | 6 | 6 |
| 33 | 15 | 6 | 0.03 | 0.27 | 3 | 6 | 5 |
| 34 | 25 | 13 | 0.05 | 0.25 | 3 | 9 | 7 |
| 35 | 35 | 14 | 0.06 | 0.23 | 4 | 15 | 10 |
| 36 | 32 | 14 | 0.05 | 0.24 | 3 | 12 | 13 |
| 37 | 27 | 13 | 0.05 | 0.24 | 3 | 11 | 9 |
| 38 | 27 | 16 | 0.05 | 0.21 | 3 | 10 | 9 |

Sliding speed: 100 Hz.

When the head was slided by 200000 times, the contact resistance (mΩ) of each sample was measured by conducting currents of 0.1 A and 1.0 A and the area of the frictional portion thereof was measured by conducting an current of 1.0 A.

Coefficient of dynamic friction:

Head: a rod formed of Ag—50% Pd and having a head portion with a radius of 1 mm

Slide distance: 10 mm

The number of sliding times: 100

Sliding speed: 100 mm/min.

When the head was slided by 100 times, the coefficient of dynamic friction (μK) was measured.

Atmospheric heating test and temperature and humidity test:

In the case of the air heating test, a test piece was heated in an atmospheric air of 150° C. for 100 hours, and a load of 5 g and an current of 0.1 A were applied before and after the test and the contact resistance (mΩ) was measured.

In the case of the temperature and humidity test, a test piece was left in an atmosphere of temperature of 50° C. and relative humidity of 95% for 100 hours, and a load of 5 g and a current of 0.1 A were applied before

What is claimed is:

1. An electric contact material consisting essentially of (a) lithium oxide of 0.01 to 2.0% by weight when represented in terms of Li;

(b) an oxide of at least one rare earth element of 0.05 to 0.10% by weight when represented in terms of the rare earth element; and (c) the remainder being Ag or a Ag alloy.

2. The electric contact material according to claim 1, wherein the rare earth element is at least one lanthanide group element selected from the group consisting of La, Ce, Pr, Nd, and Sm.

3. The electric contact material according to claim 1, wherein said remainder is a Ag alloy which contains at least one element selected from a group consisting of In, Sn, Zn, Mn, Pd, Sb, Cu, Mg, Pb, Cd, Cr and Bi in an amount of 0.1 to 1.0% by weight, in the case of Zn and Mn, the amount of each is less than 0.5% by weight.

4. The electric contact material according to claim 1, wherein said remainder is a Ag alloy which contains at least one element selected from the group consisting of Fe, Ni and Co in an amount of 0.03 to 0.6% by weight.

5. The electric contact material according to claim 1, wherein said remainder is a Ag alloy which contains at least one element selected from the group consisting of In, Sn, Zn, Mn, Pd, Sb, Cu, Mg, Pb, Cd, Cr and Bi in an amount of 0.1 to 1.0% by weight, in the case of Zn and Mn, the amount of each is less than 0.5% by weight and at least one element selected from the group consisting of Fe, Ni and Co in an amount of 0.03 to 0.6% by weight.

6. In a slide contact which includes an electric contact material, the improvement wherein the electric contact material is the electric contact material of claim 1.

7. An electric contact material according to claim 1, wherein the amount of lithium oxide is 0.01 to 0.1% by weight when represented in terms of Li.

8. The electric contact material according to claim 7, wherein the rare earth element is at least one lanthanide group element selected from the group consisting of La, Ce, Pr, Nd and Sm.

9. An electric material consisting essentially of (a) 0.01 to 2 weight % lithium oxide when represented in terms of Li;

(b) 0.05 to 0.10 weight % of an oxide of at least one rare earth element when represented in term of the rare earth element;

(c) the remainder being Ag or a Ag alloy and (d) a base material of Cu, a Cu alloy, Fe or an Fe alloy.

* * * * *